US006156081A

United States Patent [19]

Willis-New

[11] Patent Number: 6,156,081

[45] Date of Patent: Dec. 5, 2000

[54] COMBUSTION CATALYST

[75] Inventor: John David Willis-New, Gauteng, South Africa

[73] Assignee: Combustion Technologies, Inc., Great Neck, N.Y.

[21] Appl. No.: 09/402,202

[22] PCT Filed: Apr. 8, 1998

[86] PCT No.: PCT/US98/06919

§ 371 Date: Sep. 30, 1999

§ 102(e) Date: Sep. 30, 1999

[87] PCT Pub. No.: WO98/46703

PCT Pub. Date: Oct. 22, 1998

[30] Foreign Application Priority Data

| | | | |
|---|---|---|---|
| Apr. 11, 1997 | [ZA] | South Africa | 97/3089 |
| Mar. 26, 1998 | [ZA] | South Africa | 98/2580 |

[51] Int. Cl.[7] ..... C10L 1/18; C10L 1/16

[52] U.S. Cl. ..... 44/351; 44/300; 44/308

[58] Field of Search ..... 44/308, 351, 300

[56] References Cited

U.S. PATENT DOCUMENTS

| | | |
|---|---|---|
| 2,646,348 | 7/1953 | Neudeck . |
| 3,066,018 | 11/1962 | McGuire . |
| 3,273,981 | 9/1966 | Furey . |
| 4,604,102 | 8/1986 | Zaweski et al. . |
| 4,968,321 | 11/1990 | Sung et al. . |

*Primary Examiner*—Jerry D. Johnson
*Attorney, Agent, or Firm*—Howard M. Ellis; Marianne Fuierer

[57] ABSTRACT

The invention relates to combustion catalyst compositions which when blended into liquid hydrocarbon-base fuels reduce deposits in fuel combustion systems, inhibit corrosion in fuel systems and facilitate a more efficient oxidation of fuel. The combustion catalyst compositions comprise a surface-active/emulsifier agent, a lubricating oil and a liquid saturated hydrocarbon having the general formula $C_nH_{2n+2}$ wherein n is from 14 to 17.

25 Claims, No Drawings

COMBUSTION CATALYST

CROSS REFERENCE TO RELATED APPLICATION

This application claims the benefit of Copending International Application PCT/US98/06919, filed Apr. 8, 1998.

TECHNICAL FIELD

The present invention relates generally to fuel additive compositions and in particular to combustion catalyst compositions which when blended into liquid hydrocarbon-base fuels reduce deposits in internal combustion engines, inhibit corrosion in fuel systems and facilitate a more efficient oxidation of fuel for improved fuel mileage and reduced exhaust emissions.

BACKGROUND OF THE INVENTION

Fuel additives are used today to improve the performance of gasoline and diesel fuels either because the hydrocarbon components themselves contain some deficiency or adding a small amount of an additive is more effective than changing the composition of these fuels. The primary thrust of research and development in the field of fuel additives has been towards attempting to provide fuels which contain deposit control additives. Effectively controlling or inhibiting deposit formations in the intake system, such as carburetor, valves, etc., of internal combustion engines can improve fuel efficiency. However, this must be accomplished without contributing to combustion chamber deposits which can produce harmful exhaust emissions with subsequent damage to catalytic converters and the environment.

Deposits in the combustion chamber of an internal combustion engine can contribute to an increase in smoke and exhaust emissions. Smoke originates principally from two sources within the engine: first, unburned or partly oxidized fuel, and second, unburned carbon that has been formed by thermal decomposition of the fuel that has not reacted with oxygen. Thus, a chemically correct and uniform mixture of fuel and air is necessary at the instant of ignition for fuel efficiency. However, this can only be accomplished if fuel and carbon deposits are prevented from inhibiting the flow of air and fuel into the combustion chamber.

In addition to unwanted deposits in an engine, inclusion of water in hydrocarbon-base fuels may reduce fuel oxidation and cause a blockage in the fuel system. Water may be present from moisture condensing out of hot fuel as it cools in storage tanks or pipelines. Also, acidic or caustic water may be carried over inadvertently from various processes in the refinery. Corrosion-causing free water in the fuel system of a vehicle can lead to severe problems. Not only can leaks develop in automobile fuel tanks, but particles of rust can block fuel lines, filters, fuel injection nozzles and critical carburetor orifices, such as jets. Moreover, water in fuel can prevent ignition and/or complete oxidation of the fuel. As a result, there is an increased need for adding corrosion inhibitors to hydrocarbon-base fuels.

Accordingly, improved fuel additive compositions are needed that inhibit corrosion in the fuel system, reduce incomplete combustion deposits, reduce exhaust emissions, and increase fuel combustion and efficiency.

SUMMARY OF THE INVENTION

The present invention provides a group of combustion catalyst compositions for blending with combustible liquid hydrocarbon-base fuels that are designed to improve fuel combustion and efficiency, inhibit corrosion, reduce exhaust emissions and reduce the deposition of carbon in an engine. Also, the combustion catalyst compositions are stable and hydrocarbon-base fuel miscible, with no undesirable side effects on fuel performance or on fuel storage stability. Moreover, the combustion catalyst compositions of the present invention may be mixed with fuel in bulk either at the refinery, at a distribution center, or at point of sale. The compositions can also be mixed with fuel in a gas tank of a vehicle by the operator of the vehicle.

For purposes of this invention, the terms and expressions below, appearing in the specification and claims, are intended to have the following meanings:

"Combustion Catalyst" or variations thereof means a fuel additive which enhances the combustion of primary fuel to improve the complete oxidation of fuel, minimize formation of deposits and exhaust emissions, and/or improve overall operating efficiency of fuel combustion systems such as, an internal combustion engine.

"Straight-chain liquid saturated hydrocarbon" means an alkane hydrocarbon or a mixture of alkane hydrocarbons having the general formula $C_nH_{2n+2}$ wherein n is from 14 to 17, and excludes cycloalkanes, aromatics and unsaturated hydrocarbons.

"Lubricating oil" means an oil product that reduces friction between solids, is liquid at room temperature and is a member selected from the group consisting of vegetable oil, synthetic oil, mineral oil and mixtures thereof, the mineral oil being characterized as virtually colorless, having a flash point of at least from about 220° C. to about 260° C., a pour point from about −15° C. to about −22° C., density from about 0.83 Kg/L to about 0.90 KG/L, and excludes the "straight-chain liquid saturated hydrocarbon" defined above.

"Internal combustion engine" means an engine in which the fuel is ignited either by a spark or compression including, but not limited to, the Otto engine or gasoline engine, diesel or oil engine, gas turbine, stratified charge and Wankel-type engines.

The combustion catalyst compositions of the present invention which are miscible in gasoline, diesel fuels and other liquid hydrocarbon-base fuels comprise a blended mixture of a surface-active/emulsifier agent, a lubricating oil, and a straight-chain liquid saturated hydrocarbon. Generally, the components of the compositions are present in proportional ranges sufficient to achieve combustion catalytic effects when blended with hydrocarbon-base fuels and burned.

More specifically, the fuel miscible combustion catalyst compositions comprise an admixture of a fatty acid ester of sorbitan or a mixture of fatty acid esters of sorbitan, a mineral oil and a straight-chain liquid saturated hydrocarbon.

A further object of the present invention is to provide a fuel mixture characterized by a composition comprising an admixture of a fatty acid ester of sorbitan or a mixture of fatty acid esters of sorbitan, a mineral oil, a straight-chain liquid saturated hydrocarbon and a hydrocarbon-base fuel.

A still further object of the present invention is to provide a method of improving fuel combustion and reducing incomplete combustion deposits in an engine while burning a liquid hydrocarbon-base fuel which comprises:

a) providing a fuel miscible combustion catalyst composition comprising (i) combining a fatty acid ester of sorbitan or mixture of fatty acid esters of sorbitan, a lubricating oil and a straight-chain liquid saturated hydrocarbon or mixture of straight-chain liquid saturated hydrocarbons;

b) adding the combustion catalyst composition of step (a) to the liquid hydrocarbon-base fuel in the engine, wherein the ratio of combustion catalyst composition to liquid hydrocarbon-base fuel is from about 1:200 to about 1:2000; and c) operating the engine.

DESCRIPTION OF THE PREFERRED EMBODIMENTS

The combustion catalyst compositions of the present invention comprise an admixture of a surface-active/emulsifier agent, a lubricating oil and a straight-chain liquid saturated hydrocarbon. It had been found that the components of the combustion catalyst compositions have specific qualities and functions which improve the operating performance and efficiency of an internal combustion engine. In addition, the combustion catalyst compositions are useful as additives to other hydrocarbon-base fuels, such as blending with #2 fuel heating oil used in central heating units and boilers, or kerosene based fuels including jet fuels to improve oxidation of fuels and reduce carbon buildup and/or smoke.

In the present invention the surface-active/emulsifier agent which is incorporated into the combustion catalyst compositions has both surface-active properties and emulsifier properties. The surface-active properties prevent buildup of gum or varnish-like substances on critical fuel handling components, such as fuel injection system parts, fuel carburetors, and the like.

The emulsifying properties of the surface-active/emulsifier agent disperse water molecules in hydrocarbon fuels and protect critical fuel handling components from rust and corrosion. The emulsifier forms a stable mixture of two immiscible liquids by holding the water molecules in a suspension and dispersing them in the fuel thereby reducing the rate of coalescence of the water molecules. Accordingly, fugitive moisture and water particles are passed through the system dispersed in the fuel without settling out. This movement of moisture through the system reduces the opportunity for corrosion or rust buildup in the fuel system.

A general guideline for selecting the appropriate surface-active/emulsifier agent to be used in the present invention is based on the HLB method. In this method, the value of the HLB number is indicative of the agent's emulsification behavior. This value is related to the balance between the hydrophilic and lipophilic portions of the molecule. Emulsifying agents that are preferentially oil-soluble form w/o emulsions and have a low HLB value. A HLB value of 3–6 is the recommended range for w/o emulsification to be used in the present invention, and more preferably, a HLB value from about 4 to about 5.

Incorporating the surface-active/emulsifier agent in the combustion catalyst compositions of the present invention also reduces buildup of deposits in components of the fuel handling system. When an engine is idling, high-boiling fuel components, such as olefins and aromatics, together with contaminants from exhaust and crankcase fumes drawn in through the air cleaner, may accumulate on the interior walls of a carburetor just below the throttle valve. By interfering with air flow and altering the air/fuel ratio, the resulting deposits can cause rough idling, frequent stalls, poor performance and increased fuel consumption. Thus, the surface-active/emulsifier agent also serves by coating the metal surfaces in the fuel intake system thereby reducing deposition on the surface.

It has also been found that the surface-active/emulsifier agents used in the present invention may also impart useful antistatic properties to hydrocarbon-base fuels because of the polar nature of the lipophilic and hydrophilic groups of the surface-active/emulsifier agents. Many volatile organic liquid compositions, such as hydrocarbon-base fuels have low electrical conductivity which can generate electrostatic charges that tend to form on the surface of fuels. These charges may result in sparking and possible ignition of fuel or an explosion during handling or transporting. Thus understood, the surface-active/emulsifier agents of the present invention will sufficiently increase electrical conductivity of hydrocarbon-base fuels and help to control static buildup.

Accordingly, any surface-active/emulsifier agent that reduces corrosion, reduces fuel system deposits and/or has antistatic properties may be employed in the present invention. Preferably, a nonionic fatty acid ester of sorbitan and/or sorbitan esters of mixed fatty acids having the following general formula:

(I)

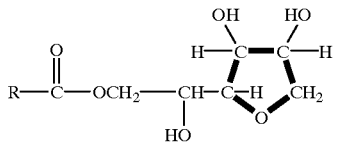

where RCO— is a fatty acid radical including but not limited to oleic acid, stearic acid, lauric acid, palmitic acid, myristic acid, ricinoleic acid and/or mixtures thereof may be used in the present invention. Preferred representatives of useful sorbitan esters within formula (I) include monooleate, monostearate, monopalmitate and monolaurate and a mixture thereof. More preferably, a sorbitan monooleate is used characterized by an acid value from about 5.5 to about 7.5 mgms, a hydroxyl value from about 193 to about 209, a saponification value from about 149 to about 160 mgms, and a HLB number from about 4 to about 5. A particularly preferred sorbitan monooleate is commercially available from Croda Inc., East Yorkshire, England and sold under the trademark of Crill 4™.

Generally, oil-soluble nonionic surface-active/emulsifier agents should be used in an amount that is sufficient to inhibit corrosion, increase electrical conductivity and/or prevent deposits when the fuel is burned. Sorbitan esters are typically present in an amount from about 3 to about 9 percent based on the total weight of the fuel additive composition. Unless otherwise stated, the parts and percentages used in the present invention are by weight. More specifically, the sorbitan esters are most effective when incorporated in an amount from about 4 to about 7 percent.

The combustion catalyst compositions of the present invention further contain a lubricating oil having several functions including but not limited to the reduction of foaming in fuels and/or reduction of deposits in fuel handling components, such as inlet valves, injectors, manifolds and so on.

Incorporating surface-active agents into liquid hydrocarbon-base fuels may cause some foaming of the fuel and this foaming can be reduced by the addition of a lubricating oil. Not only is foaming a problem with tank filling but foam in an engine can cause poor performance because of inconsistent fuel mixture in the system. The most effective antifoaming agents have a surface tension low enough in the pure state so that they can spread spontaneously over the existing film, thereby inhibiting foam formation. In the present invention it has been found that incorporating a lubricating oil may reduce foaming in the fuels.

Additionally, a lubricating oil performs as a solvent which tends to help rinse away deposits that may form in the fuel intake system of a gasoline engine, including the carburetor, manifold, injectors and underside of the intake valves. The mechanism for forming these deposits is not well understood, but it is believed to be due to several different reasons, including increased use of oxygenated fuels, higher levels of olefins and cracked stock, intermittent injectors spray and valves which do not properly rotate. Porous deposits can act as sponge-like build-ups and absorb fuel, making the air/fuel ratio too lean, and leading to poor engine performance. Deposits can form around valve openings and interfere, for example, with closing of valves. Also, tacky deposits can sometimes find their way up the valve stem and cause the valves to stick. Deposits on the fuel injectors can plug the injectors causing fuel flow to be erratic and reduce atomization which may lead to higher exhaust emissions. It has been found that a high boiling lubricating oil, one that will not evaporate too rapidly, will dissolve the sticky, deposit forming compounds which are subsequently swept into the combustion chamber.

Additionally, the combustion catalyst compositions of the present invention may be used in oil burning furnaces, oil burning hot-water heaters, jet engines, generators and the like to help reduce sticky deposits in fuel lines, oil burner fuel injectors and the like.

A wide variety of effective lubricating oils may be utilized in the present invention to control induction system deposits and to help maintain vehicle performance, fuel economy and reduce exhaust emissions. These include mineral oil, the so called synthetic oils, vegetable oil and a mixture thereof. A refined mineral oil which is preferred can be characterized as being virtually colorless, having a flash point of at least from about 220° C. to about 260° C., a pour point from about −15° C. to about −22° C. and density from about 0.83 Kg/L to about 0.90 KG/L and more preferably a flash point of at least 238° C., a pour point of about −18° C. and a density of about 0.8645 Kg/L.

Generally, lubricating oil is used in a sufficient amount to help reduce deposits in the intake system of an internal combustion engine and/or reduce foaming in fuels. More specifically, good performance is achieved with an amount ranging from about 35 to about 52 percent, and optimally in an amount ranging from about 45 to about 50 percent.

The present invention further provides for incorporating straight-chain liquid saturated hydrocarbons represented by the general formula $C_nH_{2n+2}$ wherein n is from 14 to 17. It has been found that the addition of straight-chain liquid saturated hydrocarbons improves fuel flow by reducing waxing of diesel type fuels and/or by reducing deposits in combustion chambers of internal combustion engines.

Middle distillate petroleum fuels, such as diesel fuel may contain paraffinic hydrocarbon waxes, which at low temperatures tend to precipitate in large crystals and form a gel structure causing fuel to become too viscous. The wax structures that come out of solution tend to form an interlocking structure which will prevent fuel from flowing. In the present invention it has been found that the straight-chain liquid saturated hydrocarbons inhibit the growth of these wax structures thereby improving fuel flow, especially at low operating temperatures.

The incorporation of straight-chain liquid saturated hydrocarbons in the combustion catalyst compositions also reduces exhaust emissions and smoke formation due to incomplete combustion deposits. Several different kinds of fuel-formed carbonaceous deposits may be laid down on surfaces in combustion chambers including, but not limited to, injectors found in compression ignition engines and spark plugs in spark ignition engines.

In diesel engines, deposits may form on both the injectors and cylinders. Lacquer-like deposits may be laid down inside the injector body causing fuel flow to diminish or injectors to seize. In gasoline engines, deposits may form on spark plug surfaces in addition to piston heads and cylinder heads. These deposits can inhibit the flow of air and/or fuel thereby preventing a stoichiometric mixing of both. Commonly referred to as injector or plug fouling, these fuel-derived deposits can increase smoke and exhaust emissions.

The formation of smoke in internal combustion engines is complex and mainly contributed to the reaction which occurs when excess fuel is injected into combustion chambers. The smoke consists primarily of carbon particles or agglomerates of varying size, together with associated condensed fuel. A possible mechanism for reduction of exhaust emissions and smoke by straight-chain liquid saturated hydrocarbons of the present invention may be attributed to the reduction of carbon-base particulate matter in the combustion chamber. Without limitation and by theory only, this inventor believes that the straight-chained liquid saturated hydrocarbons having predominately a tetradecane carbon backbone function mainly by preventing agglomeration of particulate matter and dissolving pre-formed deposits. These actions provide for cleaner combustion with improved fuel flow and efficiency due to a more stoichiometric air/fuel mixture.

Any straight-chain liquid saturated hydrocarbon or mixture of straight-chain liquid saturated hydrocarbons having the general formula of $C_nH_{2n+2}$ wherein n is from 14 to 17 may be utilized in the present invention. Preferably, tetradecane is used. If there is more than 14 carbons in the hydrocarbon chain then methyl branching of any extra carbons is preferred. Most preferably, at least 94 percent of the straight-chain liquid saturated hydrocarbons should be tetradecane with any remaining straight-chain liquid saturated hydrocarbons having a carbon backbone of tetradecane with methyl branching. Such compounds are characterized by boiling points in the range from about 230 to about 280, a minimum flash point from about 115° C. to 175° C. and an average molecule mass of about 198 g/mole.

It is beneficial to employ the straight-chain liquid saturated hydrocarbons in the combustion catalyst compositions in an amount sufficient to improve fuel flow and reduce deposits in the device being fueled therewith. Preferably, the predominately straight-chain liquid saturated hydrocarbons are present in an amount ranging from about 35 to about 52 percent, and more preferably, from about 45 to about 50 percent based on total weight of the combustion catalyst composition.

The combustion catalyst composition may additionally contain other conventional fuel additives such as a biocide and/or dye.

As stated earlier, hydrocarbon fuels when kept in storage tanks such as oil refineries, tankers for distribution and even small fuel tanks contain a small or even trace amounts of water. Some species of bacteria can exist in this water, deriving their nutrition from the hydrocarbon phase and trace elements found in water. A beneficial side effect of lead in gasoline is its biocidal properties, i.e. it prevents microbial growth. However, with the use of unleaded gasoline, there is a need to add biocides in not only gasoline, but also middle distillates, such as diesel fuel. Microbial activity in fuel tanks can cause fuel discoloration and the suspended matter can cause blockage of filters if drawn out with the fuel. A number of commercial biocides are available which may be used in the present invention including sodium compounds, boron compounds, amines and imines. Accordingly, treatment with an effective amount of a biocidal compound can greatly reduce the growth of microbes on the side of tanks and tank water bottoms. Preferably, the biocidal compound is employed in a trace amount ranging from about 0.02 to about 0.05 percent based on total weight of the combustion catalyst composition.

Dyes may be added to the fuel additive compositions without causing any adverse effects or reducing the effectiveness of the fuel additive compositions. A dye added to a fuel distinguishes one fuel from another and may function as a marker to supply evidence in the case of tax evasion, theft, fuel adulteration, and for identifying sources of leaks. Levels must be kept very low because it is important that fuels do not stain light colored vehicles if a spill occurs during filling. The dyes may be any color including red, orange, blue or green. Any dye compound may be employed including azo, triphenylmethane, phthalein, quinoid, and indigoid in an amount approximately from about 0.1 to about 0.5 percent based on total weight of the fuel additive composition. Accordingly, any green azo dye that is soluble not only in the combustion catalyst composition but also in the liquid hydrocarbon-base fuel may be used in the present application.

A particularly preferred formulation of the combustion catalyst compositions of the present invention is presented in Table 1.

TABLE 1

| Additive | % by weight |
|---|---|
| Surface-active/emulsifier agent | 6.00 |
| Mineral oil | 46.90 |
| $C_{14}$-$C_{17}$ n-saturated hydrocarbon | 46.90 |
| green azo dye | .20 |
| | 100.00 |

Testing of the novel combustion catalyst compositions for suitability in internal combustion engines was carried out in several different trucks. Results from road testing are summarized below.

EXAMPLE I

Part 1. Preparation of a Combustion Catalyst Composition

The temperature of the individual components of the combustion catalyst composition was between about 20°–28° C. before combining. The composition was formulated by the following steps of:

a) 47 parts by weight of a straight-chain liquid saturated hydrocarbon were mixed with 6 parts by weight of sorbitan monooleate, the surface-active/emulsifier agent. The saturated hydrocarbon component was a carbon chain of $C_{14}$–$C_{17}$, wherein at least 94% of the hydrocarbons were tetradecane and the remaining percentage comprised straight-chain saturated hydrocarbons having a $C_{14}$ backbone and short chain methyl groups. The sorbitan monooleate was purchased from Croda Inc., East Yorkshire, England and sold under the trade name of Crill 4™.

b) 47 parts by weight of a mineral oil were then added to the mixture of part (a). The mineral oil was characterized as a white mineral oil having a flash point of at least 238° C., a pour point of −18° C. and a density of 0.8645 Kg/L.

Part 2. Field Engine Testing

The testing was conducted to determine if the combustion catalyst of Part 1 above provided improved fuel combustion thereby reducing fuel consumption. The testing was conducted on ninety-three (93) Mercedes-Benz trucks under urban operating conditions over an eight month period. During the first four months of the test, the vehicles were driven without the combustion catalyst composition added to the fuel. During the next four months the combustion catalyst composition was added to the trucks' diesel fuel supply during each refueling forming a fuel mixture having approximately a combustion catalyst/fuel ratio of 1:1000.

The results of the eight month testing program are provided in the following table.

TABLE 2

| Type of Vehicles | Number of Vehicles | Fuel Type | Additive/ Fuel Ratio | Operating Conditions | Fuel treated/month |
|---|---|---|---|---|---|
| Mercedes Trucks | 93 | Diesel | 1:1000 | Urban | 65,000 Liters |

FUEL ADDITIVE TRIAL TEST REPORT FOR 4 MONTH TEST

| Non-treated Fuel | 1st mo. | 2nd mo. | 3rd mo. | 4th mo. | 4-Month Average |
|---|---|---|---|---|---|
| Fuel Consumption Average Lit./100 km | 27.5 | 26.25 | 28.2 | 28 | 27.5 |
| **Treated Fuel** | **5th mo.** | **6th mo.** | **7th mo.** | **8th mo.** | **4-Month Average** |
| Fuel Consumption Average Lit./100 km | 25.25 | 23 | 23 | 23 | 23.5 |

The test results indicate that a 14.5 percent average fuel consumption reduction was achieved by using the combustion catalyst compositions of the present invention.

I claim:

1. A fuel miscible combustion catalyst composition comprising an admixture of a surface-active/emulsifier agent, a lubricating oil and a liquid saturated hydrocarbon or mixtures of liquid saturated hydrocarbons having the general formula $C_nH_{2n+2}$ wherein n is from 14 to 17, said hydrocarbons comprising a sequence of at least 14 carbon atoms extending in a straight chain, and any carbon atoms in excess of 14 may be a straight chain extension or a branch from said straight chain.

2. The combustion catalyst composition of claim 1 wherein the ingredients are present in proportional ranges sufficient to achieve a combustion catalytic effect when blended with a hydrocarbon-base fuel and oxidized.

3. The combustion catalyst composition of claim 1 wherein at least about 94 percent of said liquid saturated hydrocarbon is of the general formula $C_{14}H_{30}$.

4. The combustion catalyst composition of claim 3 wherein said surface-active/emulsifier agent is sorbitan monooleate.

5. The combustion catalyst composition of claim 4 wherein said lubricating oil is a mineral oil.

6. The combustion catalyst composition of claim 5 wherein said mineral oil has a minimum flash point of about 238° C., a pour point of about −18° C., a density of about 0.8645 Kg/L at 20° C. and a viscosity of about 68.73 cSt at 40° C.

7. The combustion catalyst composition of claim 5 comprising from about 4 to about 7 percent by weight sorbitan monooleate; from about 35 to about 52 percent by weight mineral oil and from about 35 to about 52 percent by weight liquid saturated hydrocarbon.

8. The combustion catalyst composition of claim 7 further comprising from about 0.1 to about 0.5 percent of a hydrocarbon-base fuel soluble dye.

9. A fuel mixture composition comprising the combustion catalyst of claim 7 and a hydrocarbon-base fuel.

10. The combustion catalyst composition according to claim 1 wherein said surface-active/emulsifier agent comprises a sorbitan ester having the general formula of:

(I)

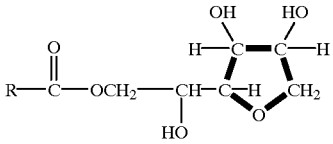

wherein RCO— is a fatty acid radical.

11. The combustion catalyst composition of claim 10 wherein said fatty acid radical is a member selected from the group consisting of oleic, stearic, lauric, palmitic, myristic, ricinoleic and mixtures thereof.

12. The combustion catalyst composition of claim 10 wherein said sorbitan ester within formula (I) is a member selected from the group consisting of monooleate, monostearate, monopalmitate, monolaurate and mixtures thereof.

13. The combustion catalyst composition of claim 1 wherein said lubricating oil is a member selected from the group consisting of mineral oil, synthetic oil, vegetable oil, and mixtures thereof.

14. The combustion catalyst composition of claim 1 wherein said surface-active/emulsifier agent has an acid value ranging from about 5.5 to about 7.5 mgms, a hydroxyl value ranging from about 193 to about 209, a saponification value ranging from about 149 to about 160 mgms and a HLB value of 4.1 to about 4.5.

15. A fuel mixture composition comprising the combustion catalyst of claim 1 and a hydrocarbon-base fuel.

16. The fuel mixture of claim 15 wherein said hydrocarbon-base fuel is a member selected from the group consisting of gasoline, diesel fuel, fuel oil, heating oil, liquid coal and aviation fuel.

17. The fuel mixture of claim 15 wherein the ratio of combustion catalyst to hydrocarbon-base fuel ranges from about 1:200 to about 1:2000.

18. The combustion catalyst composition of claim 1 wherein the liquid saturated hydrocarbon is a member selected from the group consisting of a straight-chain liquid saturated hydrocarbon and a branched-chain liquid saturated hydrocarbon.

19. The combustion catalyst composition of claim 1 wherein the liquid saturated hydrocarbon comprises a mixture of a straight-chain liquid saturated hydrocarbon and a branched-chain liquid saturated hydrocarbon.

20. A method of improving fuel combustion and/or reducing the deposition of carbon in combustion areas of an engine while burning a liquid hydrocarbon-base fuel by the steps which comprise:

a) providing a fuel miscible combustion catalyst composition comprising:

(i) a surface-active/emulsifier agent, a lubricating oil, and a liquid saturated hydrocarbon or mixtures of liquid saturated hydrocarbons having the general formula $C_nH_{2n+2}$ wherein n is from 14 to 17, said hydrocarbons comprising a sequence of at least 14 carbon atoms extending in a straight chain, and any carbon atoms in excess of 14 may be a straight chain extension or a branch from said straight chain;

b) blending said combustion catalyst composition with a liquid hydrocarbon-base fuel, the ratio of said combustion catalyst composition to said liquid hydrocarbon-base fuel ranging from about 1:200 to about 1:2000; and c) operating said engine.

21. The method of claim 20 wherein said combustion catalyst composition comprises from about 5 to about 7 percent by weight surface-active/emulsifier agent; from about 45 to about 50 percent by weight mineral oil and from about 45 to about 50 percent by weight liquid saturated hydrocarbon.

22. The method of claim 20 including the further step of introducing a biocidal agent in a sufficient amount to reduce microbes in a fuel distribution system.

23. The method of claim 20 wherein said liquid hydrocarbon-base fuel is a member selected from the group consisting of gasoline, diesel fuel, fuel oil, heating oil, liquid coal and aviation fuel.

24. The method of claim 20 wherein the liquid saturated hydrocarbon of the combustion catalyst composition is a member selected from the group consisting a of straight-chain liquid saturated hydrocarbon and a branched-chain liquid saturated hydrocarbon.

25. The method of claim 20 wherein the liquid saturated hydrocarbon of the combustion catalyst composition comprises a mixture of a straight-chain liquid saturated hydrocarbon and a branched-chain liquid saturated hydrocarbon.

* * * * *